US008326205B2

(12) United States Patent
Miyazaki

(10) Patent No.: US 8,326,205 B2
(45) Date of Patent: Dec. 4, 2012

(54) MEDIUM CUTTING DEVICE, IMAGE RECORDING APPARATUS HAVING THE MEDIUM CUTTING DEVICE, AND CONTROLLING METHOD OF THE MEDIUM CUTTING DEVICE

(75) Inventor: Yasuhiro Miyazaki, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 134 days.

(21) Appl. No.: 12/883,458

(22) Filed: Sep. 16, 2010

(65) Prior Publication Data

US 2011/0002727 A1 Jan. 6, 2011

Related U.S. Application Data

(63) Continuation of application No. PCT/JP2009/001191, filed on Mar. 17, 2009.

(30) Foreign Application Priority Data

Mar. 24, 2008 (JP) ..... 2008-075339

(51) Int. Cl.

| | |
|---|---|
| ***B65H 35/06*** | (2006.01) |
| ***B65H 35/08*** | (2006.01) |
| ***B65H 29/54*** | (2006.01) |
| ***B65H 29/56*** | (2006.01) |
| ***G03G 15/00*** | (2006.01) |
| ***G03G 21/00*** | (2006.01) |

(52) U.S. Cl. ..... 399/385; 399/406; 242/526; 242/527; 400/621

(58) Field of Classification Search ..... 399/385, 399/406

See application file for complete search history.

(56) References Cited

U.S. PATENT DOCUMENTS

| | | | | |
|---|---|---|---|---|
| 5,228,373 | A * | 7/1993 | Welsch | 83/24 |
| 5,300,012 | A * | 4/1994 | Kamada | 493/459 |
| 5,660,349 | A * | 8/1997 | Miller et al. | 242/526.1 |
| 5,690,009 | A * | 11/1997 | Nakao et al. | 83/76.8 |
| 7,503,518 | B2 * | 3/2009 | Corrado et al. | 242/526 |

(Continued)

FOREIGN PATENT DOCUMENTS

EP 625476 A1 * 11/1994

(Continued)

OTHER PUBLICATIONS

International Search Report dated May 26, 2009 (in English) in counterpart International Application No. PCT/JP2009/001191.

(Continued)

*Primary Examiner* — Daniel J Colilla
*Assistant Examiner* — Nguyen Q Ha
(74) *Attorney, Agent, or Firm* — Holtz, Holtz, Goodman & Chick, PC

(57) ABSTRACT

A medium cutting device for cutting a conveyed continuous medium in a predetermined length includes a cutting unit having a cut roller that is freely rotatable and is provided with a cut blade for cutting the continuous medium on an outer surface, and an anvil roller arranged to face the cut roller, and brush rollers that are arranged to face each other on a further downstream side than the cutting unit in a conveyance direction, and prevent a sheet-shaped recording medium cut by the cutting unit from being entangled with one of the rollers of the cutting unit. A linear speed of the outermost perimeter of each of the brush rollers is made faster than a conveyance speed of the continuous medium conveyed by the cutting unit.

9 Claims, 7 Drawing Sheets

U.S. PATENT DOCUMENTS

2007/0280765 A1* 12/2007 Shida et al. ..... 399/406

FOREIGN PATENT DOCUMENTS

| | | | | |
|---|---|---|---|---|
| JP | 54-86203 | | | 6/1979 |
| JP | 1-22120 | B2 | | 4/1989 |
| JP | 03111368 | A | * | 5/1991 |
| JP | 04358658 | A | * | 12/1992 |
| JP | 6-46692 | Y2 | | 11/1994 |
| JP | 08281594 | A | * | 10/1996 |
| JP | 10218471 | A | * | 8/1998 |
| JP | 2001-310848 | A | | 11/2001 |
| JP | 2004142052 | A | * | 5/2004 |
| JP | 2004-291219 | A | | 10/2004 |
| JP | 2005297412 | A | * | 10/2005 |

OTHER PUBLICATIONS

Japanese Office Action dated Jun. 5, 2012 issued in counterpart Japanese Application No. 2008-075339.

* cited by examiner

MEDIUM CUTTING DEVICE, IMAGE RECORDING APPARATUS HAVING THE MEDIUM CUTTING DEVICE, AND CONTROLLING METHOD OF THE MEDIUM CUTTING DEVICE

CROSS-REFERENCE TO RELATED APPLICATIONS

This is a Continuation Application of PCT Application No. PCT/JP2009/001191, filed Mar. 17, 2009, which was not published under PCT Article 21 (2) in English.

This application is based upon and claims the benefit of priority from the prior Japanese Patent Application No. 2008-075339, filed Mar. 24, 2008, the entire contents of which are incorporated herein by reference.

FIELD

The present invention relates to a medium cutting device for cutting a conveyed continuous medium in a predetermined length, an image recording apparatus having the medium cutting device, and a controlling method of the medium cutting device.

BACKGROUND

Conventionally, business printers, copiers and the like are provided with a medium cutting device for cutting a continuous medium, wound in the form of a roll, in a predetermined length after the continuous medium is printed (for example, see Japanese Examined Patent Application Publication No. HEI1-22120).

Japanese Examined Patent Application Publication No. HEI1-22120 discloses a technique of providing a plurality of facing brush rollers at predetermined intervals on a downstream side of a medium conveyance direction of a cut roller and a receiving side roller, and of conveying a medium by drawing the medium in between the brush rollers.

SUMMARY

One aspect of the present invention is a medium cutting device for cutting a conveyed continuous medium in a predetermine length. The medium cutting device includes: a cutting unit including a cutting side rotator provided with a cut blade for cutting the continuous medium on an outer surface, and a receiving side rotator arranged to face the cutting side rotator; and an entanglement preventing unit, provided with a pair of rotators arranged to face each other on a further downstream side of a conveyance direction than the cutting unit, for preventing the continuous medium cut by the cutting unit from being entangled with one of the cutting side rotator and the receiving side rotator, wherein a linear speed of an outermost perimeter of the rotator in the entanglement preventing unit is made faster than a conveyance speed of the continuous medium conveyed by the cutting unit.

Another aspect of the present invention is an image recording apparatus including: a supporting unit for supporting a continuous medium with an outer surface; a recording unit, arranged to face the supporting unit, for recording the continuous medium; and a predetermined medium cutting device.

A further aspect of the present invention is a controlling method of a medium cutting device for cutting a conveyed continuous medium in a predetermine length. The controlling method includes: a cutting step of cutting the continuous medium with a cutting side rotator provided with a cut blade on an outer surface, and a receiving side rotator arranged to face the cutting side rotator; and an entanglement preventing step of preventing the continuous medium cut by the cutting step from being entangled with one of the cutting side rotator and the receiving side rotator by using a rotation of a pair of rotators arranged to face each other on a further downstream side than a cut position of the continuous medium in a conveyance direction, wherein a linear speed of an outermost perimeter of the rotator in the entanglement preventing step is made faster than a conveyance speed of the continuous medium in the cutting step.

DESCRIPTION OF EMBODIMENTS

Embodiments according to the present invention are described below with reference to the drawings.

First Embodiment

Figure 1:
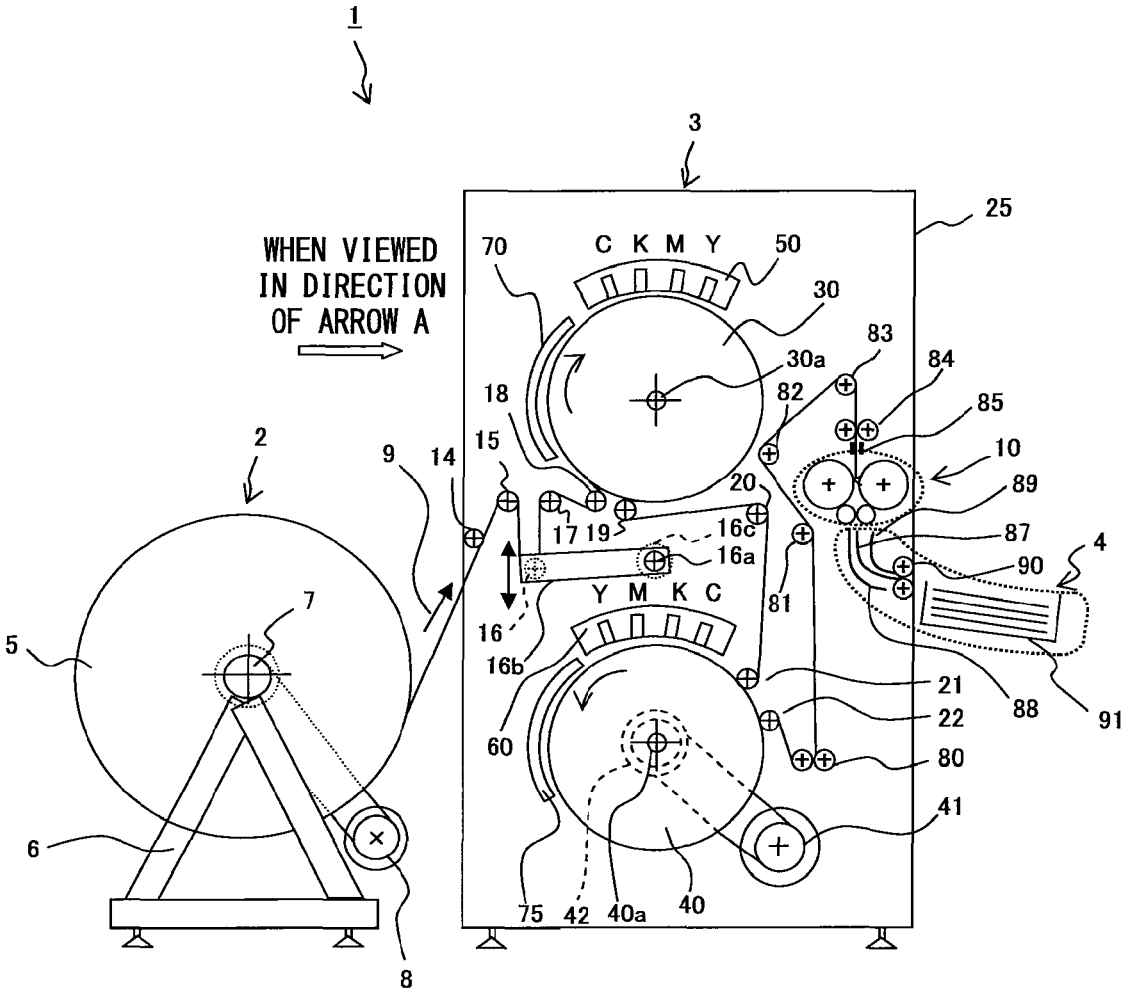
FIG. 1 schematically illustrates a front view of a conveyance system of a recording medium in an image recording apparatus.
Figure 2:
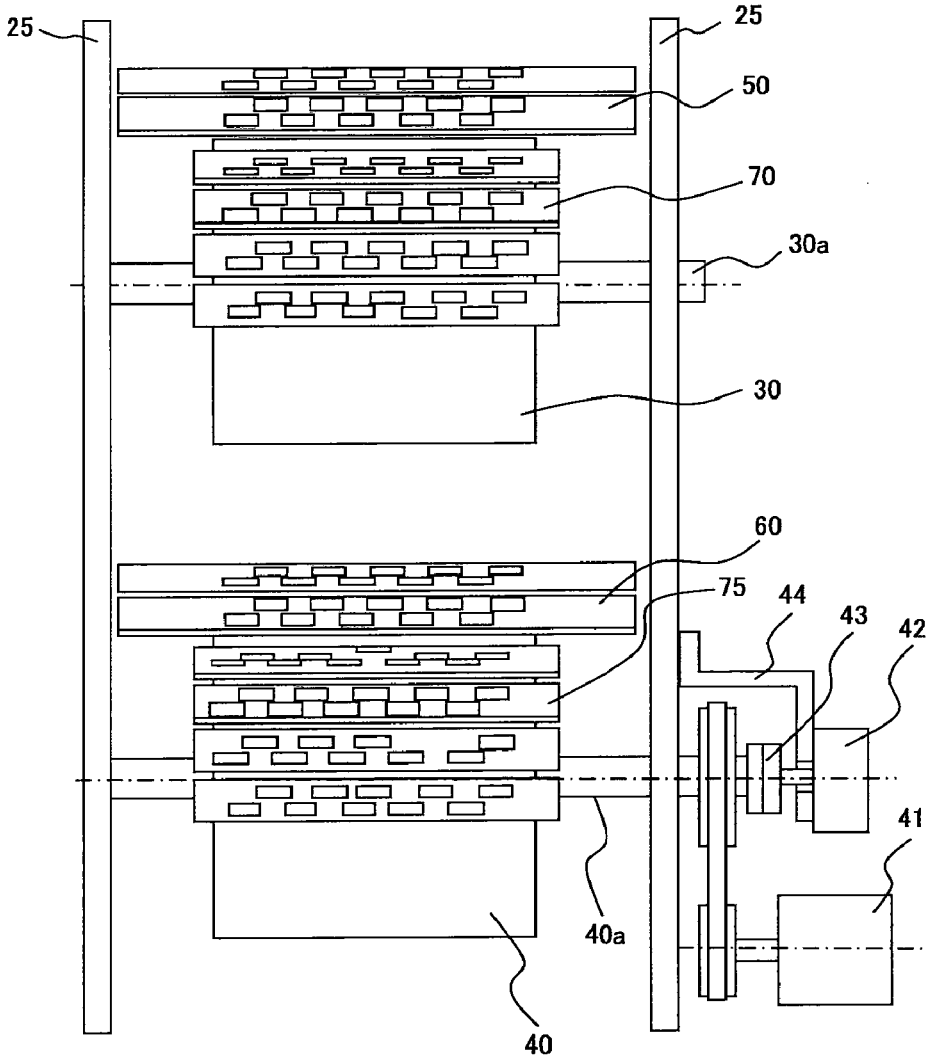
FIG. 2 illustrates a printer unit when viewed in a direction of an arrow A.

FIG. 1 schematically illustrates a front view of a conveyance system of a recording medium 5 in an image recording apparatus 1 according to a first embodiment. FIG. 2 schematically illustrates a side view of a printer unit when viewed in a direction of an arrow A in FIG. 1.

The image recording apparatus 1 includes an unwinder unit 2 as a recording medium supplying unit, a printer unit 3 as a recording unit for recording an image on the recording medium 5, an ejecting unit 4 for ejecting the recording medium 5, and a medium cutting device 10.

The unwinder unit 2 includes a stand 6, a paper core fixing shaft 7, and a brake 8. The unwinder unit 2 holds the recording medium 5 to be rotatable with the paper core fixing shaft 7, and supplies the recording medium 5 to the printer unit 3.

In this embodiment, a continuous medium such as roll paper or the like is used as the recording medium 5. The stand 6 supports the paper core fixing shaft 7 to be rotatable. On the paper core fixing shaft 7, a plurality of nail parts (not illustrated) for chucking an inner diameter of a paper core by injecting air via an air inlet not illustrated protrude in a radius direction.

As a result, the nail parts of the paper core fixing shaft 7 bite into the inner diameter of the paper core of the recording medium 5, which is securely held.

To the paper core fixing shaft 7, the brake 8 is connected via a pulley and a belt although these are not described in detail. Braking force of the brake 8 is transferred to the paper core fixing shaft 7. As a result, the brake 8 applies a tension in a direction reverse to a conveyance direction of the recording medium 5.

The printer unit 3 is described next.

The printer unit 3 is configured with a conveying unit of the recording medium 5 composed of a plurality of rollers 14 to 22 and 80 to 84, a first drum 30 as a supporting unit, and a second drum 40 as a supporting unit, the medium cutting device 10, a body frame 25, a first recording unit 50, a second recording unit 60, a first maintenance unit 70, and a second maintenance unit 75.

To the printer unit 3, the recording medium 5 fed from the unwinder unit 2 is led as represented by an arrow 9.

The recording medium 5 led to the printer unit 3 is conveyed to the first drum 30 via a conveyance system composed of free rollers 14, 15, a swing roller 16, and free rollers 17, 18.

The swing roller 16 is installed to be able to turn in both forward and backward directions at a tip of an arm 16*b* that is held, by the body frame 25, to be able to turn with a turn center 16*a*.

The swing roller 16 configures a tension generating part for applying a tension with the self-weights of the swing roller 16 and the arm 16*b* to the recording medium 5 conveyed along a bottom surface of the swing roller 16.

Additionally, the tension generating part also has a function of canceling a sag if the sag occurs on the recording medium 5 due to fluctuations of the tension caused by an eccentricity or the like of the recording medium 5 held by the unwinder unit 2.

Furthermore, the turn center 16*a* is provided with a potentiometer 16*c* for detecting a turning position when the swing roller 16 moves upward and downward.

According to an output signal of the potentiometer 16*c*, the brake 8 linked to the paper core fixing shaft 7 of the unwinder unit 2 is activated. As a result, the tension of the recording medium 5 is controlled. Note that the free rollers 14, 15, 17 and 18 are supported to be rotatable by the body frame 25.

The recording medium 5 conveyed to the first drum 30 via the above described conveyance system is wound around the first drum 30 as a supporting unit by the free rollers 18 and 19 at a winding angle of 330 degrees.

The first drum 30 is a hollow cylinder made of, for example, aluminum. A rotational axis 30*a* of the first drum 30 is supported to be rotatable by the body frame 25. Moreover, one end of a member that supports the first recording unit 50 to be described later, and one end of a member that supports the first maintenance unit 70 to be described later are engaged with the rotational axis 30*a*.

The first drum 30 rotates in a clockwise direction of FIG. 1 by being supported by the rotational axis 30*a*. The recording medium 5 held by the first drum 30 is conveyed immediately below the first recording unit 50 arranged to face the first drum 30. Then, a surface of the recording medium 5 is recorded by the first recording unit 50.

The winding angle of 330 degrees of the recording medium 5 around the first drum 30 is set as follows. Namely, assuming that a tension on a winding end side of the first drum 30 is T2, a tension on a winding start side is T1, a static frictional coefficient between the first drum 30 and the recording medium 5 is $\mu$ and a winding angle is $\theta$, these values are set so that a relationship (Eytelwein formula) represented by $T2/T1=\exp(\mu\theta)$ is satisfied.

By way of example, for a recording medium 5 having the static frictional coefficient $\mu$ with the first drum 30 of 0.07 when T1 and T2 are respectively 35 N and 50 N, e is set to 330 degrees in consideration of the phenomenon that the first drum 30 and the recording medium 5 do not slide. Also the second drum 40 as a supporting unit to be described later is similarly set.

As described above, by widely securing the winding angle of the recording medium 5 around the first drum 30 as wide as approximately 330 degrees as in this embodiment, the recording medium 5 applies a vertical force to an outer surface of the first drum 30 with the tension of the winding start of the first drum 30 by the swing roller 16, and the tension of the winding end by a nip roller 80 to be described later.

As a result, the frictional force between the first drum 30 and the recording medium 5 increases. Therefore, a slide does not occur between the first drum 30 and the recording medium 5, and the recording medium 5 can be held in close contact with the first drum 30. In consequence, precise paper conveyance and a control of the number of rotations of the drum can be implemented.

The surface of the recording medium 5 wound around the first drum 30 is a surface that is processed with stable and high precision of size and has an area as wide as 330 degrees. Therefore, a number of first recording units 50 can be arranged in a circumferential direction of the first drum 30 in order to improve the resolution of an image recorded on the recording medium 5.

Additionally, printing quality can be stably detected by a printing quality detecting device (not illustrated) for detecting printing quality after recording. There is also an advantage such that UV (ultraviolet) rays can be illuminated under a stable curing condition by arranging a UV curing lamp (not illustrated) needed for UV ink or the like.

In the above described configuration, the first drum 30 is a driven drum rotated by the second drum 40 via the recording medium 5.

The recording medium 5 after the winding end of the first drum 30, namely, the recording medium 5 the surface of which has been recorded by the first recording unit 50 is conveyed to the second drum 40 via a conveyance system of free rollers 19, 20 and 21.

The recording medium 5 conveyed to the second drum 40 is also wound around the second drum 40 by the free rollers 21 and 22 at the winding angle of 330 degrees.

Similar to the first drum 30, the second drum 40 is a hollow cylinder made of, for example, aluminum. A rotational axis 40*a* of the second drum 40 is supported to be rotatable by the body frame 25. Moreover, one end of a member that supports the second recording unit 60 to be described later and one end of a member that supports the second maintenance unit 75 to be described later are engaged with the rotational axis 40*a*.

Also the free rollers 19, 20 and 21 are supported to be rotatable by the body frame 25.

As described above, the recording medium 5 wound around the second drum 40 at the winding angle of 330 degrees applies a vertical force to an outer surface of the second drum 40 with the tensions of the winding start and the winding end of the second drum 40.

As a result, the frictional force between the second drum 40 and the recording medium 5 increases, whereby a slide between the second drum 40 and the recording medium 5 does not occur any more. Therefore, the recording medium 5 is held by the second drum 40 in close contact therewith.

The second drum 40 is rotated in a counterclockwise direction of FIG. 1 by the driving force of a driving motor 41 linked to the rotational axis 40*a* via a pulley and a belt, which are similar to the above described ones. With the rotation of the second drum 40, the recording medium 5 held by the second drum 40 is conveyed immediately below the second recording unit 60 arranged to face the second drum 40.

For the recording medium 5 held by being wound around the second drum 40, its surface on which the image has been recorded by the first recording unit 50 at the first drum 30 is orientated downward (a surface side of the second drum 40), and a back surface on which an image is not recorded yet is orientated upward (orientated toward the second recording unit 60).

The back surface of the recording medium 5, which is held by being wound around the second drum 40 and conveyed immediately below the second recording unit 60, is recorded by the second recording unit 60. As a result, both of the surfaces of the recording medium 5 have been recorded.

As illustrated in FIG. 2, an encoder 42 of a position detecting unit is linked to the rotational axis 40*a* of the second drum 40 via a coupling 43. A housing of the encoder 42 is fixed to one end of an encoder fixing member 44 having an L-shaped cross-section. The other end of the encoder fixing member 44 is fixed to the rear face of the body frame 25.

With this configuration, the encoder 42 rotates with the rotation of the second drum 40, and outputs a detection pulse equivalent to the rotational position of the second drum 40.

The detection pulse output from the encoder 42 is input to a driving substrate, not illustrated, for driving printing heads of the first recording unit 50 and the second recording unit 60. In synchronization with the detection pulse, the printing heads jet ink according to a driving control from the driving substrate.

Namely, the recording medium 5 is conveyed at the same speed without sliding on the first drum 30 and the second drum 40. Therefore, the jetting driving of the first recording unit 50 and the second recording unit 60 can be controlled based on the detection pulse output with the rotation of the second drum 40.

For example, a rotary encoder of 18,000 pulses per rotation is used as the encoder 42. Here, assuming that a resolution of recording in the conveyance direction is 300 dpi and one dot is printed per pulse of the encoder 42, the diameter of the second drum 40 is $$25.4\ (\text{mm}) \div 300\ (\text{dpi}) \times 18{,}000\ (\text{pulse}) \div \pi\ (\text{ratio of the circumference of a circle}) = 485\ (\text{mm})$$

Additionally, in this embodiment, the diameter of the first drum 40 is made equal to that of the second drum 40. With this configuration, the printing heads of the first recording unit 50 and the second recording unit 60 jet ink in synchronization with the detection pulse of the encoder 42, and the printing heads can execute a recording process with a resolution of 300 dpi in the conveyance direction.

The first recording unit 50 and the second recording unit 60 are described next. A configuration of the second recording unit 60 is similar to that of the first recording unit 50. Therefore, the first recording unit 50 is described as a representative.

Figure 3:
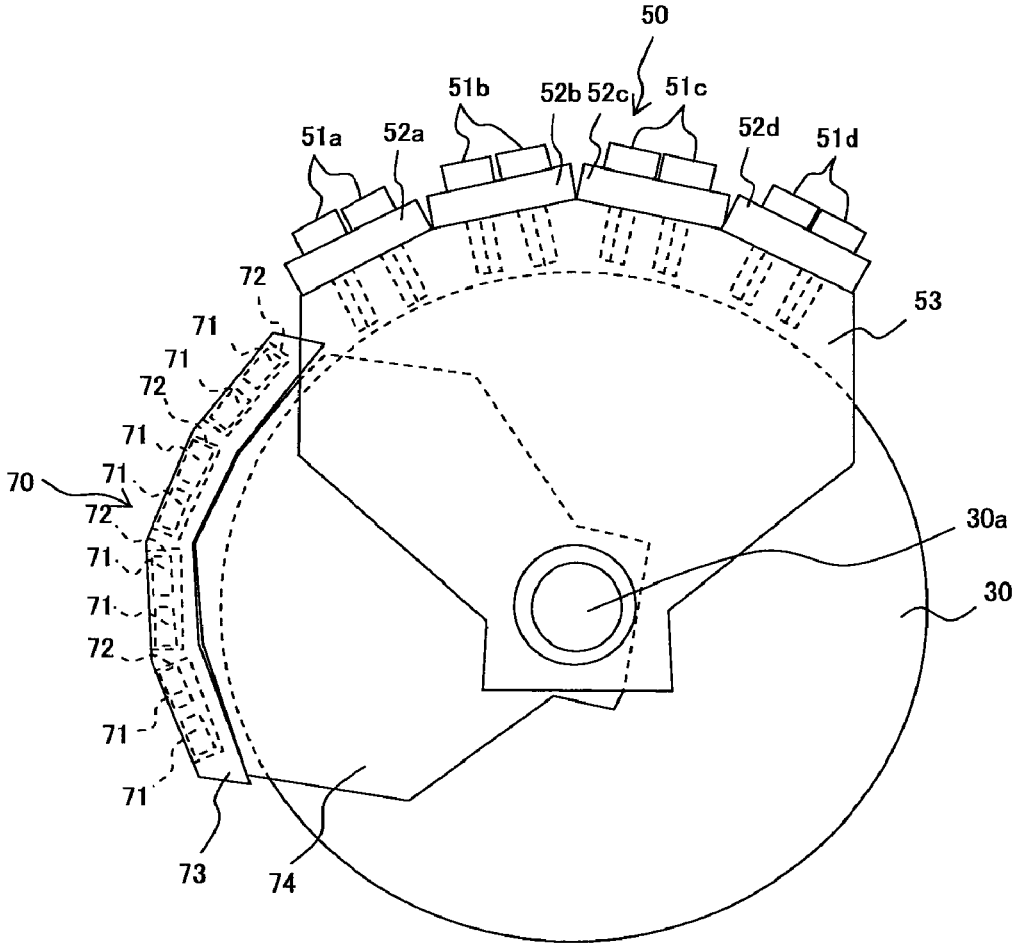
FIG. 3 schematically illustrates a front view of a first recording unit arranged to face a first drum.

FIG. 3 schematically illustrates a front view of the first recording unit 50 arranged to face the first drum 30.

The first recording unit 50 in this embodiment has printing heads 51*a*, 51*b*, 51*c* and 51*d* of a total of four colors such as cyan (C), black (K), magenta (M) and yellow (Y). The printing heads 51*a*, 51*b*, 51*c* and 51*d* are respectively arranged and fixed by being staggered with a width or more of the recording medium 5 on head holding plates 52*a*, 52*b*, 52*c* and 52*d*.

Nozzle surfaces formed on the printing heads 51*a*, 51*b*, 51*c* and 51*d* are arranged to face the printing surface of the recording medium 5 held on the outer surface of the first drum 30. Moreover, the printing heads 51*a*, 51*b*, 51*c* and 51*d* are aligned, relative to the first drum 30, by the head holding plates 52*a*, 52*b*, 52*c* and 52*d* and the head holding member 53. Furthermore, one end of the head holding member 53 is engaged with the rotational axis 30*a*. A configuration of the second recording unit 60 is similar to the above described configuration of the first recording unit 50.

The first maintenance unit 70 and the second maintenance unit 75 are described next.

The first maintenance unit 70 and the second maintenance unit 75 have a function of performing maintenance operations such as wiping, nozzle suction and the like in order to prevent nozzles of the printing heads from clogging. A configuration of the second maintenance unit 75 is similar to that of the first maintenance unit 70. Therefore, the first maintenance unit 70 is described as a representative.

FIG. 3 schematically illustrates a front view of the first maintenance unit 70 arranged to face the first drum 30. The first maintenance unit 70 illustrated in FIG. 3 includes a plurality of suction nozzles 71 corresponding to the printing heads 51*a*, 51*b*, 51*c* and 51*d* of the first recording unit 50, and four first ink pans 72 corresponding to the printing heads 51*a*, 51*b*, 51*c* and 51*d*.

The first maintenance unit 70 also includes a second ink pan 73 integrated with the first ink pans 72 as one piece to cover the four first ink pans 72, and a maintenance unit holding member 74 for holding the second ink pan 73.

The suction nozzles 71 suction ink from the printing heads 51*a*, 51*b*, 51*c* and 51*d*, and remove ink and paper dust settled on the nozzle surfaces of the printing heads 51*a*, 51*b*, 51*c* and 51*d*.

The first ink pans 72 collect ink purged when the maintenance operations are performed. The maintenance unit holding member 74 is engaged with the rotational axis 30*a* of the first drum 30 in order to align the above described components (the suction nozzles 71, the first ink pans 72 and the second ink pan 73) with the first drum 30.

With the maintenance operations, the head holding plates 52*a*, 52*b*, 52*c* and 52*d* are retracted away from the surface of the first drum 30 by a retraction mechanism that is not illustrated and provided in the head holding member 53.

As a result, also the printing heads 51*a*, 51*b*, 51*c* and 51*d* move away from the surface of the first drum 30, and a predetermined gap is formed between the bottom surfaces of the printing heads 51*a*, 51*b*, 51*c* and 51*d* and the round surface of the first drum 30.

Thereafter, the first maintenance unit 70 is moved immediately below the printing heads 51*a*, 51*b*, 51*c* and 51*d*.

The printing heads 51*a*, 51*b*, 51*c* and 51*d* are made to purge ink. Ink flowing out when being purged is collected by the four first ink pans 72 corresponding to the printing heads 51*a*, 51*b*, 51*c* and 51*d*, and the ink is collected by a waste tank not illustrated.

Then, the suction nozzles 71 in contact with the nozzle surfaces of the printing heads 51*a*, 51*b*, 51*c* and 51*d* are scanned in a nozzle row direction. With the suction nozzles 71, ink remaining on the nozzle surfaces is suctioned while ink and paper dust settled on the nozzle surfaces are being scraped off.

After the maintenance operations are performed, the first maintenance unit 70 returns to, for example, a standby position illustrated in FIG. 3. Since the first maintenance unit 70 stands by at a slanting position at this time, the ink remaining in the first ink pans 72 can possibly drip. Therefore, the second ink pan 73 is provided.

Ends of the second ink pan 73 are formed with a wall having an acute bending angle, and configured by being slanted in a depth direction of the apparatus. Therefore, even if the ink drips from the first ink pans 72, the ink is accumulated at the ends of the second ink pan 73.

The ink collected by the second ink pan 73 flows into the waste tank. With this configuration, the inside of the device, such as the recording medium 5, the first drum 30 and the like, are not contaminated with ink.

Referring back to FIG. 1. The recording medium 5, the front and the back surfaces of which have been respectively recorded by the first recording unit 50 and the second recording unit 60 as described above, is conveyed from a winding end portion of the second drum 40 by a conveyance mechanism at and after the free roller 22.

Namely, after the winding end portion of the second drum 40, the recording medium 5 is conveyed to a first nip roller pair 80 via the free roller 22. The free roller 22 and the first nip roller pair 80 are supported to be rotatable by the body frame 25.

The first nip roller pair 80 is composed of a pair of rollers. A torque limiter, a deceleration gear and a driving motor are linked to one of the rollers although these are not illustrated. The first nip roller pair 80 conveys the recording medium 5 at the same speed as the conveyance speed of the recording medium 5 on the first drum 30 and the second drum 40.

As a result, the first nip roller pair 80 configures a tension generating part for applying a tension to the recording medium 5 in the same direction as the conveyance direction of the recording medium 5.

After the first nip roller pair 80, the recording medium 5 is conveyed to a second nip roller pair 84 via free rollers 81, 82 and 83. Also the free rollers 81, 82 and 83, and the second nip roller pair 84 are supported to be rotatable by the body frame 25.

The second nip roller pair 84 is composed of a pair of rollers. A torque limiter, a deceleration gear and a driving motor are linked to one of the rollers although these are not illustrated. The second nip roller pair 84 conveys the recording medium 5 to an immediately succeeding cutting unit 92 at the same speed as the conveyance speed of the first nip roller pair 80 for the recording medium 5.

After the second nip roller pair 84, the recording medium 5 is conveyed to the medium cutting device 10 via a leading guide 85.

A conveyance path between the second nip roller pair 84 and the medium cutting device 10 is configured as short as possible. The leading guide 85 has a function of suppressing fluctuations of the recording medium 5 in its thickness direction on the conveyance path, and of leading the recording medium 5 to the medium cutting device 10.

The leading guide 85 is configured to extend in the width direction of the recording medium 5, to cover the front and the back surfaces of the recording medium 5, and to regulate the conveyance path. The leading guide 85 is a component made of, for example, a sheet metal or a molded resin. Alternatively, the leading guide 85 may be configured as a slim roller pair.

The recording medium 5 led to the medium cutting device 10 by the leading guide 85 is cut in a predetermined length into a sheet-shaped recording medium 87 by the medium cutting device 10. The sheet-shaped recording medium 87 is ejected into a storage tray 91 via ejection guides 88, 89, and an ejection roller pair 90 as an ejection member. The ejection guides 88, 89, the ejection roller pair 90 and the storage tray 91 configure an ejection unit 4.

Figure 4:
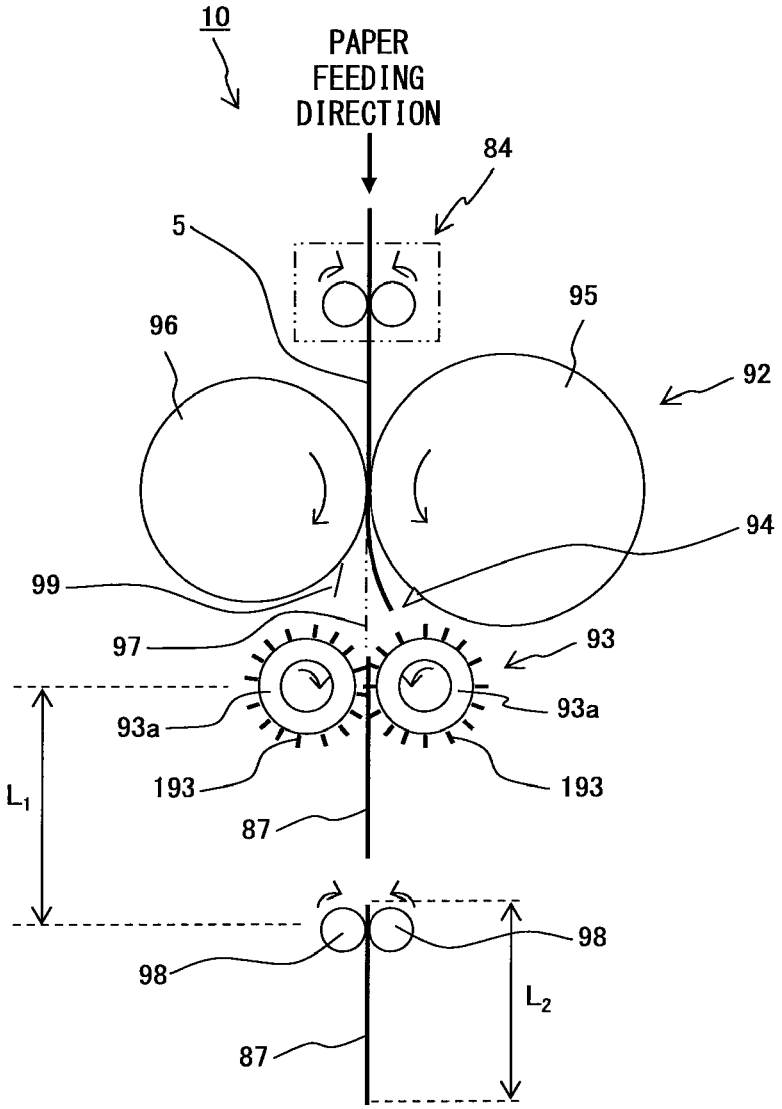
FIG. 4 illustrates an arrangement state of a medium cutting device.

FIG. 4 illustrates an arrangement of the medium cutting device 10.

The medium cutting device 10 includes a cutting unit 92, and an entanglement preventing unit 93. The cutting unit 92 has a cut roller 95 as a cutting side rotator that freely rotates and is provided with a cut blade 94 for cutting the recording medium 5 on an outer surface, and an anvil roller 96 as a receiving side rotator arranged to face the cut roller 95.

The entanglement preventing unit 93 has brush rollers 93*a*, 93*a* as a pair of facing rotators. On outer surfaces of the brush rollers 93*a*, 93*a*, a frictional member such as a rubber, a sponge or the like is formed. This embodiment is described by taking, as an example, brush rollers having many implanted linear members 193 that extend in a diameter direction of the rollers.

The entanglement preventing unit 93 is arranged to face each other on a further downstream side than the cutting unit 92 in the conveyance direction. The entanglement preventing unit 93 prevents the recording medium 5 cut by the cutting unit 92 from being entangled along the cut roller 95 or the anvil roller 96.

The continuous recording medium 5 conveyed to the second nip roller pair 84 in a paper feeding direction is led by a mechanism such as a driving roller pair or the like to the downstream side of the conveyance direction along a conveyance line 97 sandwiched between the cut roller 95 and the anvil roller 96. On the surface of the cut roller 95, the cut blade 94 for cutting the recording medium 5 is provided, for example, in a direction vertical to the conveyance direction.

A tip of the cut blade 94 makes contact with the surface of the anvil roller 96 in synchronization with the rotation of the cut roller 95, whereby the recording medium 5 is pressed and cut at a portion sandwiched between the cut blade 94 and the anvil roller 96. The cut blade 94 is configured, for example, by fixing a block having a cut tip to the cut roller 95, or by attaching and fixing, with magnetic force, a blade part, which is generated with etching or the like on a surface of a thin metal plate, to a cut roller 95 in which a magnet is buried.

The cut sheet-shaped recording medium 87 is conveyed between the conveyance roller pair 98, 98 as downstream feeding means after being conveyed between the brush rollers 93*a*, 93*a*. Then, the recording medium 87 is conveyed to the storage tray 91 (see FIG. 1) or a post-processing device such as a binding machine or the like not illustrated.

Here, immediately after the continuous recording medium 5 is cut with the cut blade 94 of the cut roller 95, the tip of the next recording medium 5 sometimes deviates from the conveyance line 97, and moves in a direction of winding around the cut roller 95 or the anvil roller 96. This is caused, for example, by a winding habit settled by the winding of the continuous recording medium 5 wound in the form of a roll, by a winding habit settled by a roller having a small diameter arranged within the conveyance system on a further upstream side than the second nip roller pair 84 when the continuous recording medium 5 stays at the roller, by static electricity, or by a cockling at the time of printing on the recording medium 5.

The recording medium 5 wound around the anvil roller 96 can be returned to the conveyance line 97, for example, by arranging a guide blade 99 below the anvil roller 96. However, since the surface of the cut roller 95 is provided with the cut blade 94 for cutting the recording medium 5, the guide blade 99 cannot be arranged below the cut roller 95.

Accordingly, the tip of the recording medium 5 sometimes moves in a direction of winding around the outer surface of the cut roller 95. However, the tips of the linear members 193 arranged around the brush roller 93*a* act in a direction of returning the tip of the recording medium 5 to the conveyance line 97 side.

Figure 5:
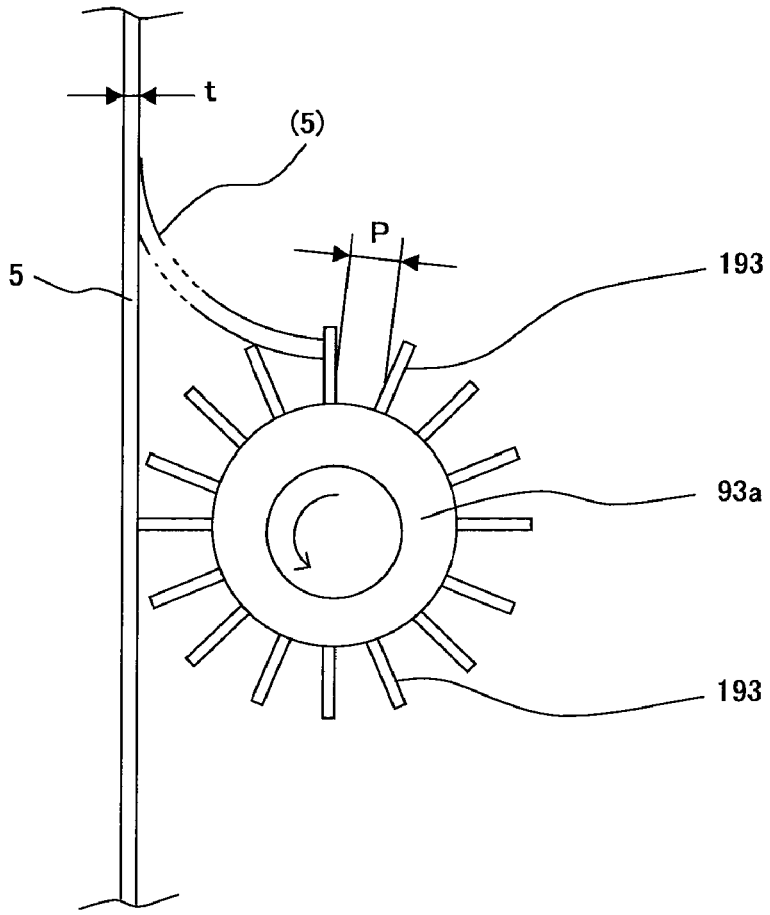
FIG. 5 illustrates a relationship between an interval between linear members of a brush roller and a thickness of a recording medium.

In this case, as illustrated in FIG. 5, assuming that an interval between adjacent linear members 193 on the brush roller 93*a* is P and the thickness of the recording medium 5 is t, the following relationship is satisfied.

$$P \geqq t$$

If this relationship is satisfied, the recording medium 5 wound around the outer surface of the cut roller 95 is returned to the conveyance line 97 side by being allowed to enter in between the linear members 193 and by being rotated in the state of entering the linear members 193. In contrast, if the interval P between the linear members 193 is smaller than the thickness t of the recording medium 5, the linear members 193 only slidingly contact an end face of the recording medium 5, and they cannot securely return the recording medium 5 to the conveyance line 97 side. By satisfying this relationship, the recording medium 5 is less prone to a jam.

However, if the linear speed of the tips of the linear members 193 is almost the same as the conveyance speed of the recording medium 5, a probability of avoiding the jam decreases. This state is described with reference to FIG. 6.

In this figure, a radius r represents a track of the tip of the cut blade 94 of the cut roller 95, and a radius R represents a track of the tip of the linear member 193 of the brush roller 93*a*.

The recording medium 5 winds around the outer surface of the cut roller 95, and reaches a contact point T that is a position almost in contact with the brush roller 93*a*. The tip of the recording medium 5, which winds around the outer surface in a form represented by an arc $C=r\cdot\alpha$ starting at the contact point T, is moved to a nip position U along the tips of the linear members 193 with the rotation of the brush roller 93*a*. A length of a track of the moved tip of the recording medium 5 at this time is represented by an arc $A=R\cdot\theta$.

In the meantime, the recording medium 5 moved to the conveyance line 97 proceeds in the conveyance direction by a distance of $B=R\cdot\sin\theta$ even while the tip of the recording medium 5 is being moved by the brush roller 93*a*. Accordingly, the moved recording medium 5 sags by a distance, as represented by the arc C, longer than an original moving distance $H=r\cdot\sin\alpha$ of the tip of the recording medium 5 when the recording medium 5 does not wind around the cut roller 95.

Figure 6:
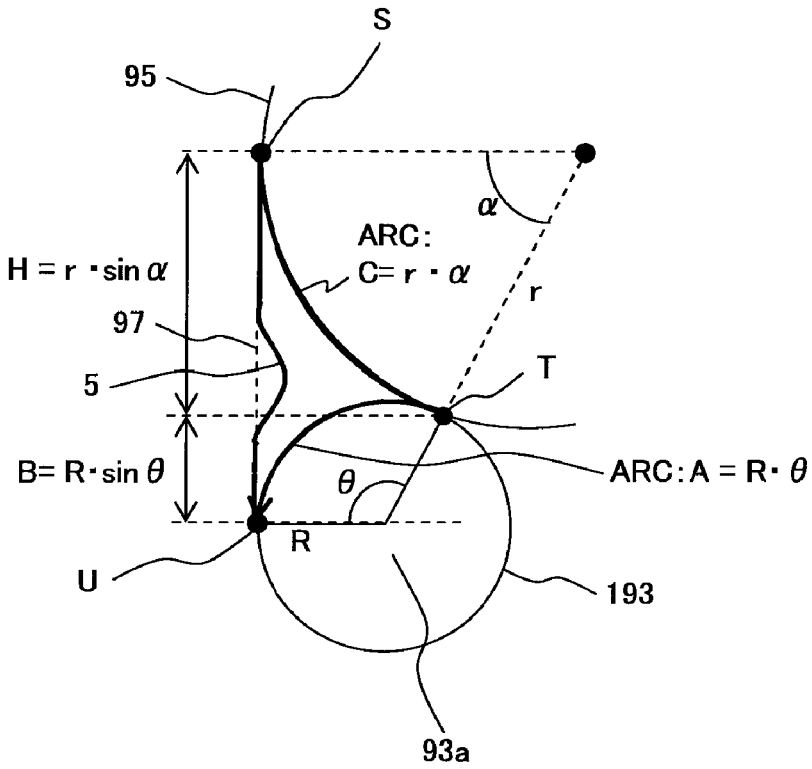
FIG. 6 illustrates a state where a sag occurs on a conveyed recording medium.

Accordingly, as is known from FIG. 6, the moved recording medium 5 less sags if the speed at which the tip of the recording medium 5 moves on the track represented by the arc $A=R\cdot\theta$ is high.

Based on the above description, the condition that the moved recording medium 5 does not sag is represented with the following expression.

Assuming that the linear speed of the tip of the cut blade 94 of the cut roller 95 is a, the linear speed of the outermost perimeter of the brush roller 93*a* is b, the position at which the recording medium 5 is cut with the tip of the cut blade 94 of the cut roller 95 is S, the contact point between the tip of the cut blade 94 of the cut roller 95 and the outermost perimeter of the brush roller 93*a* is T, the position at which the recording medium 5 is sandwiched by the brush rollers 93*a*, 93*a* is U, a central angle formed between the center of the cut roller 95, the point S and the point T is a, a central angle formed between the center of the brush roller 93*a*, the point T and the point U is θ, the radius of the tip of the cut blade 94 of the cut roller 95 is r, the radius of the outermost perimeter of the brush roller 93*a* is R, $A=R\cdot\theta$, $B=R\cdot\sin\theta$, $C=r\cdot\alpha$, and $H=r\cdot\sin\alpha$, the recording medium 5 does not sag if a length of time during which the track of the tip of the recording medium 5 reaches from the point S to the point T and from the point T to the point U is equal to or shorter than a length of time during which the track of the tip of the recording medium 5 directly reaches from the point S to the point U.

Namely, $$C/a+A/b \geqq (H+B)/a$$

Accordingly, a linear speed ratio b/a is $$b/a \geqq A/(H+B-C)=R\cdot\theta/(r\cdot\sin\theta-r\cdot\alpha)$$

This is the condition that the recording medium 5 does not sag.

For example, if R, θ, r and α are respectively set to 30 mm, 113 degrees, 69 mm, and 67 degrees, the brush roller 93*a* needs to be rotated so that the linear speed ratio of the brush roller 93*a* to the cut roller 95 is 5.7.

Figure 7:
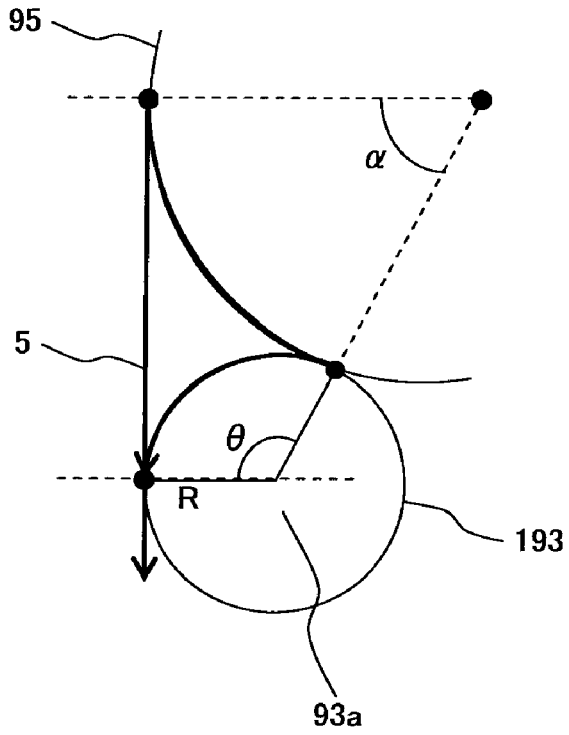
FIG. 7 illustrates a state where the sag is removed from the conveyed recording medium.

As described above, the recording medium 5 that does not sag any more as illustrated in FIG. 7 can be formed by suitably setting the linear speed ratio b/a, the rotational speeds, the diameters and the arrangements of the brush roller 93*a* and the cut roller 95.

Here, the recording medium 5 somewhat sags if the linear speed ratio of the brush roller 93*a* is set not to a value as high as 5.7 but, for example, to approximately 2 to 3 in the above described settings. However, since the linear speed of the brush roller 93 is sufficiently high compared with the conveyance speed, the sag is immediately removed by the difference between the speeds. This is an effect achieved by setting the linear speed of the brush roller 93*a* to a higher speed compared with the cut roller 95.

Normally, the conveyance speed is gradually increased by several percent as the conveyance direction goes further downstream in order to maintain the tension of the recording medium 5 between the rollers in the conveyance path. However, with an increase in the speed by several percent, the above described effect is small enough to be ignorable. Accordingly, the linear speed needs to be increased almost twice or three times in order to obtain a practically sufficient effect.

According to this embodiment, the recording medium 5 can be conveyed without a sag by making the linear speed b of the outermost perimeter of the brush rollers 93*a*, 93*a* faster than the linear speed a of the tip of the cut blade 94 of the cut roller 95. As a result, the recording medium 5 can be prevented from jamming when being ejected or the like.

Second Embodiment

A second embodiment is described next based on the above described FIG. 4.

A conveyance roller pair 98, 98 is arranged on a downstream side of the brush roller pair 93*a*, 93*a*. An interval L1 of a distance between the conveyance roller 98 and the brush roller 93*a* in the conveyance direction is set to a value larger than the length L2 of a recording medium cut with the rotations of the cut roller 95 and the anvil roller 96 (L1≧L2).

By arranging the conveyance roller pair 98, 98 in this way, the recording medium 5 can be prevented from sagging when the recording medium 5 conveyed by being nipped by the brush rollers 93*a* that are set to a speed more than twice the conveyance speed is conveyed by being nipped simultaneously by the conveyance rollers 98 that are set to almost the same linear speed as the conveyance speed.

Here, if the conveyance speed c of the conveyance roller 98 is set to a speed equal to the conveyance speed b of the brush roller 93*a*, the recording medium 5 does not sag if it is simultaneously conveyed by two rollers having different conveyance speeds as described above. Accordingly, the restriction condition of the interval between rollers with respect to the length L2 of the recording medium can be eliminated, whereby the degree of freedom of an arrangement increases.

The above description is based on the condition that the conveyance force of the brush roller 93*a* for the recording medium 5 is not 0. However, the conveyance force of the brush roller can be reduced to 0 by setting the interval between the facing brush rollers to a value larger than the thickness of the recording medium. By setting the interval in this way, the restriction on the interval between the brush roller 93*a* and the conveyance roller 98 can be eliminated.

Namely, if the nipping force of the tips of the brushes are set to 0 at a medium driving point where the brush rollers 93*a* make contact with each other, the conveyance speed of the brush rollers can be reduced to 0 with the entanglement preventing function maintained. Even though the conveyance speeds of the brush roller 93*a* and the conveyance roller 98 are different, the recording medium 5 does not sag or excessively tightens also when the distance between the rollers is set to a distance shorter or longer than the length L2 of the medium.

Additionally, by setting the interval between the cut position S of the cut roller 95 and the conveyance roller 98 to a value larger than the length L2 of the recording medium 5, the entanglement preventing function implemented by the brush roller 93*a* can be obtained and an external force to the recording medium while being cut can be removed. As a result, stable conveyance immediately after the recording medium 5 is cut, and satisfactory cutting performance can be obtained. Accordingly, the degree of freedom of an arrangement size can be increased.

However, if the conveyance speed of the cut roller 95 for the recording medium 5 and that of the conveyance roller 98 are different, the interval between the cut roller 95 and the conveyance roller 98 needs to be set to a distance longer than the length L2 of the medium. If both of the conveyance speeds are equal, a distance relationship between the cut roller 95 and the conveyance roller 98 is not restricted.

The embodiments according to the present invention have been respectively described. However, the present invention is not limited to the above described embodiments. Various improvements and modifications can be made within a scope that does not depart from the gist of the present invention.

For example, some components may be deleted from the entire configurations referred to in the above described embodiments, or different components of the embodiments may be suitably combined.

According to the present invention, ejection performance of a curled medium can be improved, whereby the cut medium can be prevented from jamming without being damaged at the time of ejection.

What is claimed is:

1. A medium cutting device for cutting a conveyed continuous medium to a predetermined length, comprising:

a cutting unit including a cutting side rotator provided with a cut blade for cutting the continuous medium on an outer surface, and a receiving side rotator arranged to face the cutting side rotator; and an entanglement preventing unit including a pair of rotators arranged to face each other downstream of the cutting unit in a conveyance direction, wherein the entanglement preventing unit prevents the continuous medium cut by the cutting unit from being entangled with one of the cutting side rotator and the receiving side rotator;

wherein a linear speed of an outermost perimeter of the rotators in the entanglement preventing unit is made to be faster than a conveyance speed of the continuous medium conveyed by the cutting unit;

wherein a frictional member is provided on an outer surface of each of the rotators in the entanglement preventing unit;

wherein the frictional member comprises a plurality of linear members extending in a diameter direction of each of the rotators; and wherein $P \geqq t$ is satisfied, where an interval between adjacent linear members is P and a thickness of the continuous medium is t.

2. An image recording apparatus, comprising:

a supporting unit for supporting a continuous medium with an outer surface;

a recording unit, arranged to face the supporting unit, for recording on the continuous medium; and the medium cutting device according to claim 1.

3. A medium cutting device for cutting a conveyed continuous medium to a predetermined length, comprising:

a cutting unit including a cutting side rotator provided with a cut blade for cutting the continuous medium on an outer surface, and a receiving side rotator arranged to face the cutting side rotator; and an entanglement preventing unit including a pair of rotators arranged to face each other downstream of the cutting unit in a conveyance direction, wherein the entanglement preventing unit prevents the continuous medium cut by the cutting unit from being entangled with one of the cutting side rotator and the receiving side rotator;

wherein a linear speed of an outermost perimeter of the rotators in the entanglement preventing unit is made to be faster than a conveyance speed of the continuous medium conveyed by the cutting unit; and wherein $b/a \geqq A/(H+B-C)=R\theta/(r \sin \alpha+R \sin \theta-r\alpha)$ is satisfied, where:

a linear speed of a tip of the cut blade of the cutting side rotator is a, the linear speed of the outermost perimeter of the rotators in the entanglement preventing unit is b, a position at which the continuous medium is cut with the tip of the cut blade of the cutting side rotator is S, a contact point between the tip of the cut blade of the cutting side rotator and the outermost perimeter of one of the rotators in the entanglement preventing unit is T, a position at which the continuous medium is nipped by the entanglement preventing unit is U, a central angle formed between a center of the cutting side rotator, the point S, and the point T is $\alpha$, a central angle formed between a center of said one of the rotators in the entanglement preventing unit, the point T, and the point U is $\theta$, a radius of the cutting side rotator extending to the tip of the cut blade is r, a radius of the outermost perimeter of said one of the rotators in the entanglement preventing unit is R, $A=R\theta$, $B=R \sin \theta$, $C=r\alpha$, and $H=r \sin \alpha$.

4. An image recording apparatus, comprising:

a supporting unit for supporting a continuous medium with an outer surface;

a recording unit, arranged to face the supporting unit, for recording on the continuous medium; and the medium cutting device according to claim 3.

5. A medium cutting device for cutting a conveyed continuous medium to a predetermined length, comprising:

a cutting unit including a cutting side rotator provided with a cut blade for cutting the continuous medium on an outer surface, and a receiving side rotator arranged to face the cutting side rotator;

an entanglement preventing unit including a pair of rotators arranged to face each other downstream of the cutting unit in a conveyance direction, wherein the entanglement preventing unit prevents the continuous medium cut by the cutting unit from being entangled with one of the cutting side rotator and the receiving side rotator; and a feeding unit arranged downstream of the entanglement preventing unit in the conveyance direction;

wherein a linear speed of an outermost perimeter of the rotators in the entanglement preventing unit is made to be faster than a conveyance speed of the continuous medium conveyed by the cutting unit; and wherein b>c and L1>L2 are satisfied, where:

the predetermined length in the conveyance direction of the continuous medium cut with the cut blade of the cutting side rotator is L2, the linear speed of the outermost perimeter of the rotators in the entanglement preventing unit is b, a distance between the rotators of the entanglement preventing unit and a center of the feeding unit in the conveyance direction is L1, and a conveyance speed of a rotator of the feeding unit is c.

6. An image recording apparatus, comprising:

a supporting unit for supporting a continuous medium with an outer surface;

a recording unit, arranged to face the supporting unit, for recording on the continuous medium; and the medium cutting device according to claim 5.

7. A controlling method of a medium cutting device for cutting a conveyed continuous medium to a predetermined length, the method comprising:

cutting the continuous medium with a cutting unit that includes a cutting side rotator provided with a cut blade on an outer surface, and a receiving side rotator arranged to face the cutting side rotator; and operating a pair of entanglement preventing rotators that are arranged to face each other downstream of the cutting unit in a conveyance direction to prevent the continuous medium cut by the cutting unit from being entangled with one of the cutting side rotator and the receiving side rotator;

wherein a linear speed of an outermost perimeter of the entanglement preventing rotators is made to be faster than a conveyance speed of the continuous medium conveyed by the cutting unit; and wherein $b/a \geqq A/(H+B-C)=R\theta/(r \sin \alpha+R \sin \theta-r\alpha)$ is satisfied, where:

a linear speed of a tip of the cut blade of the cutting side rotator is a, the linear speed of the outermost perimeter of the entanglement preventing rotators is b, a position at which the continuous medium is cut with the tip of the cut blade of the cutting side rotator is S, a contact point between the tip of the cut blade of the cutting side rotator and the outermost perimeter of one of the entanglement preventing rotators is T, a position at which the continuous medium is nipped by the entanglement preventing rotators is U, a central angle formed between a center of the cutting side rotator, the point S, and the point T is $\alpha$, a central angle formed between the center of said one of the entanglement preventing rotators, the point T, and the point U is $\theta$, a radius of the cutting side rotator extending to the tip of the cut blade is r, a radius of the outermost perimeter of said one of the entanglement preventing rotators is R, $A=R\theta$, $B=R \sin \theta$, $C=r\alpha$, and $H=r \sin \alpha$.

8. A controlling method of a medium cutting device for cutting a conveyed continuous medium to a predetermined length, the method comprising:

cutting the continuous medium with a cutting unit that includes a cutting side rotator provided with a cut blade on an outer surface, and a receiving side rotator arranged to face the cutting side rotator;

operating a pair of entanglement preventing rotators that are arranged to face each other downstream of the cutting unit in a conveyance direction to prevent the continuous medium cut by the cutting unit from being entangled with one of the cutting side rotator and the receiving side rotator; and feeding the cut continuous medium with a feeding rotator that is downstream of the entanglement preventing rotators in the conveyance direction;

wherein a linear speed of an outermost perimeter of the entanglement preventing rotators is made to be faster than a conveyance speed of the continuous medium conveyed by the cutting unit; and wherein b>c and L1>L2 are satisfied, where:

the predetermined length in the conveyance direction of the continuous medium cut with the cut blade of the cutting side rotator is L2, the linear speed of the outermost perimeter of the entanglement preventing rotators is b, a distance between the entanglement preventing rotators and a center of the feeding rotator in the conveyance direction is L1, and a conveyance speed of the feeding rotator is c.

9. A controlling method of a medium cutting device for cutting a conveyed continuous medium to a predetermined length, the method comprising:

cutting the continuous medium with a cutting unit that includes a cutting side rotator provided with a cut blade on an outer surface, and a receiving side rotator arranged to face the cutting side rotator; and operating a pair of entanglement preventing rotators that are arranged to face each other downstream of the cutting unit in a conveyance direction to prevent the continuous medium cut by the cutting unit from being entangled with one of the cutting side rotator and the receiving side rotator;

wherein a linear speed of an outermost perimeter of the entanglement preventing rotators is made to be faster than a conveyance speed of the continuous medium conveyed by the cutting unit;

wherein a frictional member is provided on an outer surface of each of the rotators in the entanglement preventing unit;

wherein the frictional member comprises a plurality of linear members extending in a diameter direction of each of the rotators; and wherein $P \geqq t$ is satisfied, where an interval between adjacent linear members is P and a thickness of the continuous medium is t.

* * * * *